US009456706B2

(12) United States Patent
Nguyen et al.

(10) Patent No.: US 9,456,706 B2
(45) Date of Patent: Oct. 4, 2016

(54) MERCHANDISER WITH AIRFLOW DIVIDER

(71) Applicant: Hussmann Corporation, Bridgeton, MO (US)

(72) Inventors: Ken Nguyen, St. Louis, MO (US); Timothy D. Anderson, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 81 days.

(21) Appl. No.: 13/768,230

(22) Filed: Feb. 15, 2013

(65) Prior Publication Data

US 2013/0213074 A1 Aug. 22, 2013

Related U.S. Application Data

(60) Provisional application No. 61/600,349, filed on Feb. 17, 2012.

(51) Int. Cl.
*A47F 3/04* (2006.01)

(52) U.S. Cl.
CPC ..... *A47F 3/0443* (2013.01); *A47F 3/04* (2013.01); *A47F 3/0447* (2013.01)

(58) Field of Classification Search
CPC .. A47F 3/0443; A47F 3/0447; A47F 3/0404; A47F 3/0408; A47F 3/0439; F25D 17/06; F25D 23/023; F04D 25/0613; H05K 7/2019
USPC ..... 62/256, 314, 335, 404, 337, 89, 407, 62/454, 411, 413, 414, 426; 454/193, 190, 454/192, 184, 188, 191; 415/211.2
See application file for complete search history.

(56) References Cited

U.S. PATENT DOCUMENTS 3,009,333 A * 11/1961 Rainwater ..... 62/256
3,289,432 A 12/1966 Brennan et al.

(Continued)

FOREIGN PATENT DOCUMENTS

DE 4305476 8/1993
DE 102006015992 10/2007

(Continued)

OTHER PUBLICATIONS

EP13155659.9 Extended European Search Report and Written Opinion dated May 15, 2013 (6 pages).

*Primary Examiner* — Marc Norman
*Assistant Examiner* — Ana Vazquez
(74) *Attorney, Agent, or Firm* — Michael Best & Friedrich LLP

(57) ABSTRACT

A refrigerated merchandiser includes a case defining a product display area and having a base, a lower flue, a first air passageway, and a second air passageway. The first air passageway and second air passageway are in fluid communication with the lower flue and with the product display area. The refrigerated merchandiser also includes an evaporator positioned in the first air passageway and a fan assembly positioned in the base in fluid communication with the lower flue to generate an airflow. A fan plenum into which the fan assembly is disposed includes an airflow divider to direct a first portion of the airflow to the first air passageway and to direct a second portion of the airflow to the second air passageway. The proportion of air between the first portion and the second portion is a function of the position and geometry of the airflow divider.

15 Claims, 12 Drawing Sheets

(56) References Cited

U.S. PATENT DOCUMENTS

| | | | | |
|---|---|---|---|---|
| 4,326,385 | A | 4/1982 | Ibrahim | |
| 4,361,012 | A | 11/1982 | Ibrahim | |
| 4,389,852 | A * | 6/1983 | Abraham | 62/82 |
| 4,478,047 | A | 10/1984 | Ibrahim | |
| 5,923,496 | A * | 7/1999 | Perona | 360/96.1 |
| 6,694,765 | B1 | 2/2004 | Waldschmidt et al. | |
| 7,062,932 | B2 | 6/2006 | Downs | |
| 7,162,882 | B2 | 1/2007 | Alahyari et al. | |
| 2003/0188847 | A1 * | 10/2003 | Lai et al. | 165/80.2 |
| 2007/0012059 | A1 | 1/2007 | Roche et al. | |
| 2007/0251253 | A1 * | 11/2007 | Alahyari et al. | 62/256 |
| 2009/0215380 | A1 * | 8/2009 | Lin | 454/184 |
| 2011/0259031 | A1 | 10/2011 | Anderson et al. | |
| 2013/0019621 | A1 * | 1/2013 | Wood et al. | 62/126 |

FOREIGN PATENT DOCUMENTS

| | | |
|---|---|---|
| FR | 2465446 | 3/1981 |
| JP | 62201035 A * | 9/1987 |
| WO | 2011/074994 | 12/2009 |

* cited by examiner

MERCHANDISER WITH AIRFLOW DIVIDER

BACKGROUND

The present invention relates to a merchandiser including a fan apparatus that discharges an airflow into two separate airflow paths to generate a primary air curtain and a secondary air curtain.

Generally, air is directed through one or more air passageways in a merchandiser to provide cooling to the product display area of the merchandiser. Often, a primary air curtain is provided to cool the product display area, and one or more secondary air curtains can be provided to buffer the primary air curtain and the product display area from ambient air surrounding the merchandiser. Conventional merchandisers typically utilize one fan assembly to generate a first airflow through the merchandiser (e.g., for the primary air curtain) and another, separate fan assembly to generate a second airflow through the merchandiser (e.g., for the secondary air curtain).

SUMMARY

The invention provides, among other things, a refrigerated merchandiser including a fan assembly that has an airflow divider to direct air discharged from a single fan into separate passageways to generate primary and secondary air curtains.

In one embodiment, a refrigerated merchandiser includes a case defining a product display area and having a base, a lower flue, a first air passageway, and a second air passageway. The first air passageway and second air passageway are in fluid communication with the lower flue and with the product display area. The refrigerated merchandiser also includes an evaporator positioned in the first air passageway and a fan assembly positioned in the base in fluid communication with the lower flue to generate an airflow. A fan plenum into which the fan assembly is disposed includes an airflow divider to direct a first portion of the airflow to the first air passageway and to direct a second portion of the airflow to the second air passageway. The proportion of air between the first portion and the second portion is a function of the position and geometry of the airflow divider.

In one embodiment a refrigerated merchandiser includes a case defining a product display area, a first air passageway, and a second air passageway, in which the first air passageway and second air passageway are in fluid communication with the product display area. A fan has a plurality of fan blades and is operable to generate an airflow. An airflow divider is positioned adjacent the plurality of fan blades to direct a first portion of the airflow to the first air passageway and to direct a second portion of the airflow to the second air passageway. The proportion of air between the first portion and the second portion is a function of the position and geometry of the airflow divider.

In one embodiment of a fan plenum for a refrigerated merchandiser, in which the refrigerated merchandiser includes a case defining a product display area and a lower flue, a first air passageway, and a second air passageway, and in which the first air passageway and second air passageway are in fluid communication with the lower flue and with the product display area, the fan plenum includes a top wall including a fan aperture for receiving a fan having a plurality of fan blades. The fan plenum further includes a side wall and a plenum base. An airflow divider partitions the fan plenum into a first duct and a second duct. The first duct is fluidly couplable with the first air passageway and the second duct is fluidly couplable with the second air passageway.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. As used herein and in the appended claims, the terms "upper", "lower", "top", "bottom", "front", "back", and other directional terms are not intended to require any particular orientation, but are instead used for purposes of description only.

Figure 1:
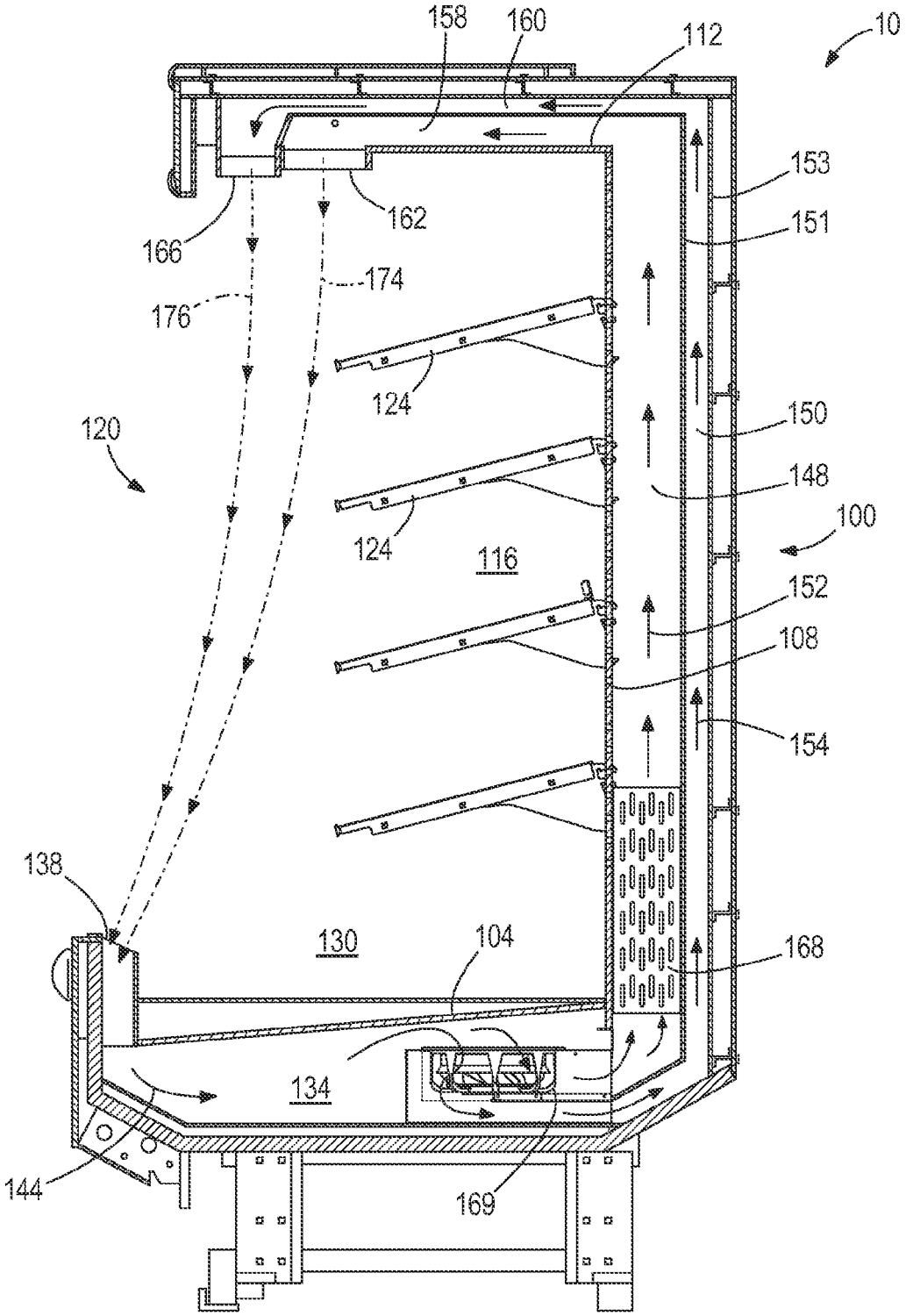
FIG. 1 is a section view of a merchandiser including a product display area, a first air passageway, a second air passageway, and a fan apparatus embodying the invention.

FIG. 1 shows a refrigerated merchandiser 10 that supports product for access by consumers. The merchandiser 10 includes a case 100 that has a base 104, a rear wall 108, and a canopy or case top 112. The area partially enclosed by the base 104, the rear wall 108, and the canopy 112 defines a product display area 116. As illustrated, the product display area 116 is accessible by customers through an opening 120 adjacent the front of the case 100. Shelves 124 are coupled to the rear wall 108 and extend forward toward the opening 120 adjacent the front of the merchandiser to support food product that is accessible by a consumer through the opening 120. Although the merchandiser illustrated and described with regard to FIGS. 1-8 is an open-front vertically-oriented merchandiser, the merchandiser can be any type of merchandiser that supports product (e.g., a horizontal merchandiser, an enclosed merchandiser with doors, etc.) All such merchandisers are considered herein.

The base 104 defines a lower portion 130 of the product display area 116 and can support a portion of the food product in the case 100. The base 104 further defines a lower flue 134 and includes an inlet 138 located adjacent the opening 120. As illustrated, the lower flue 134 is in fluid communication with the inlet 138 and conducts an airflow 144 substantially horizontally through the base 104 from the inlet 138. The inlet 138 is positioned to receive surrounding air in a substantially vertical direction to direct it into the lower flue 134.

With continued reference to FIG. 1, the case 100 includes a primary rear flue 148 and a secondary rear flue 150 extending upward from the base 104 and in fluid communication with the lower flue 134. The primary rear flue 148 is defined by the rear wall 108 and an intermediate wall 151 spaced apart from the rear wall 108 and directs a first airflow 152 generally vertically through the case 100. The secondary rear flue 150 is defined by the intermediate wall 151 and an exterior wall 153 of the case 100 and directs a secondary airflow 154 generally vertically through the case 100. In some constructions, the rear wall 108 can include apertures (not shown) that fluidly couple the primary rear flue 148 with the product display area 116 to permit at least some of the primary airflow 152 to enter the product display area 116.

The canopy 112 defines a primary upper flue 158 and a secondary upper flue 160. The primary upper flue 158 is in fluid communication with the primary rear flue 148, and the secondary upper flue 160 is in fluid communication with the secondary rear flue 150. The primary upper flue 158 directs the primary airflow 152 substantially horizontally through the canopy 112 toward a primary outlet 162. The secondary upper flue 160 directs the secondary airflow 154 substantially horizontally through the canopy 112 toward a secondary outlet 166.

The lower flue 134, the primary rear flue 148, and the primary upper flue 158 are fluidly coupled to each other to define a primary air passageway that directs a portion of the airflow 144 (i.e., the primary airflow 152) from the inlet 138 to the primary outlet 162. The lower flue 134, the secondary rear flue 150, and the secondary upper flue 160 are fluidly coupled to each other to define a secondary air passageway that directs the remaining portion of the airflow 144 (i.e., the secondary airflow 154) from the inlet 138 to the secondary outlet 166.

FIG. 1 shows that the merchandiser 10 also includes a heat exchanger or evaporator 168 that is positioned in the primary air passageway, and a fan apparatus 169 that is positioned in the base 104 and in fluid communication with the lower flue 134. As will be understood and appreciated by one of ordinary skill in the art, the heat exchanger 168 transfers heat from the primary airflow 152 to refrigerant flowing through the heat exchanger 168. As oriented, the primary airflow 152 passes substantially vertically through the heat exchanger 168. The secondary airflow 154 within the secondary rear flue 150 is defined as non-refrigerated "bypass" airflow and is not in heat exchange relationship with refrigerant flowing through the heat exchanger 168.

The primary airflow 152 that is discharged from the primary outlet 162 forms a primary air curtain 174 that is directed generally downward across the opening 120 to cool the food product within a desired or standard temperature range (e.g., 32 to 41 degrees Fahrenheit). Generally, the inlet 138 receives at least some air from the primary air curtain 174. The secondary airflow 154 that is discharged from the secondary outlet 164 forms a secondary air curtain 176 (e.g., refrigerated or non-refrigerated) that is directed generally downward across the opening 120 to buffer the primary air curtain 174 to minimize infiltration of ambient air into the product display area 116.

With reference to FIGS. 1-5, the fan apparatus 169 includes a fan assembly 170 and a plenum 172 that generates and divides the airflow 144 into the primary airflow 152 and the secondary airflow 154. As illustrated, the fan assembly 170 and the plenum 172 form a modular assembly. In some constructions, the fan assembly 170 and the plenum 172 can extend the length of the merchandiser 10.

FIGS. 2-5 show the fan assembly 170 and the plenum 172. The fan assembly 170 has a fan 200 (e.g., an axial flow or similarly constructed fan) with an inlet 204, an outlet 208, and a hub 212 that is powered by a motor (not shown). The hub 212 supports a plurality of fan blades 216, and a shroud 220 encircles and is fixed to the fan blades 216. As illustrated, the shroud 220 rotates with the blades 216 during operation of the fan 200. Support arms 224 form a basket that surrounds the shroud 220. Each support arm 224 adjoins a flange 230 that couples the fan assembly 170 to the plenum 172.

Figure 2:
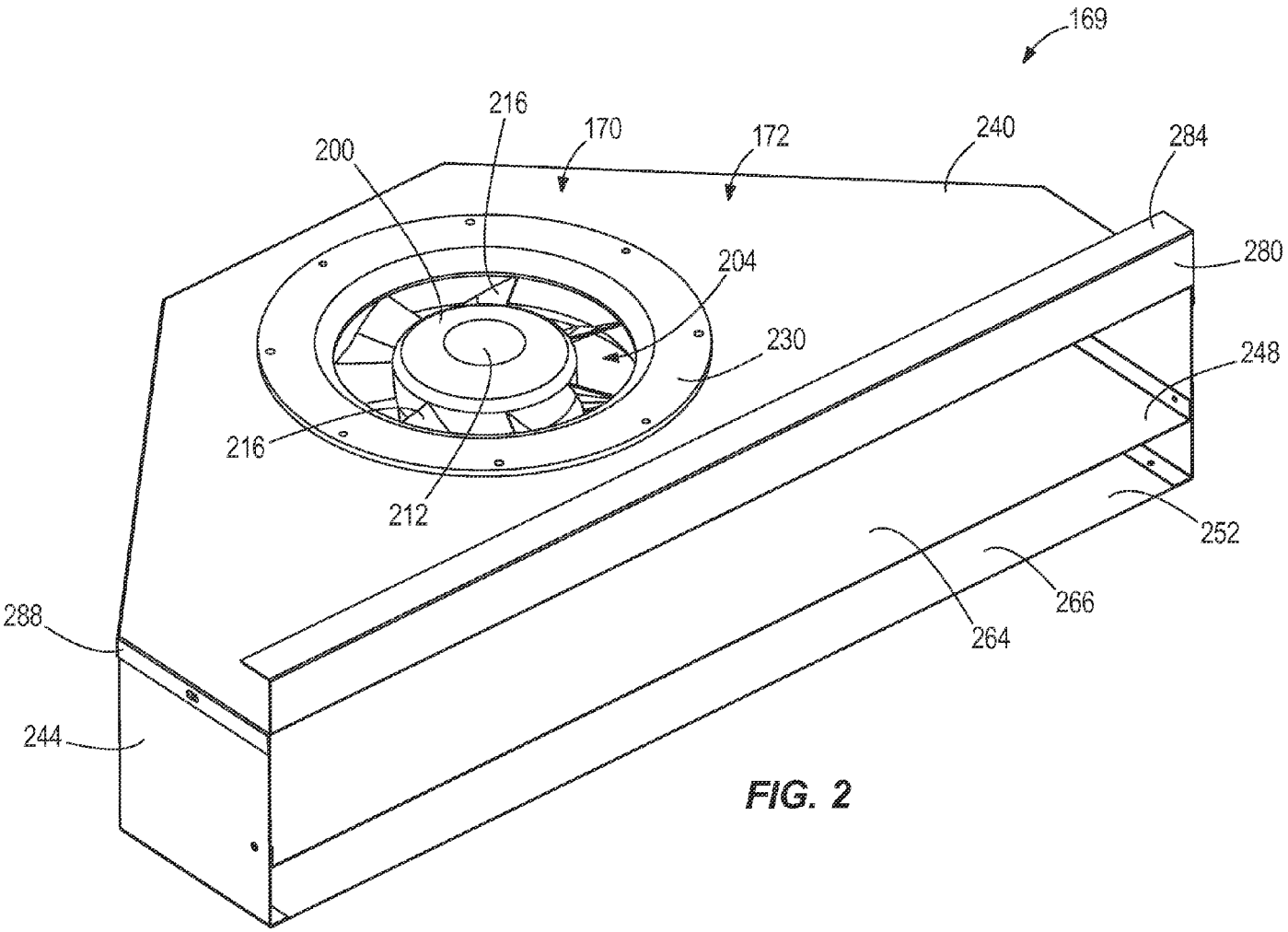
FIG. 2 is a perspective view of the fan apparatus including a fan assembly and a plenum of FIG. 1.
Figure 4:
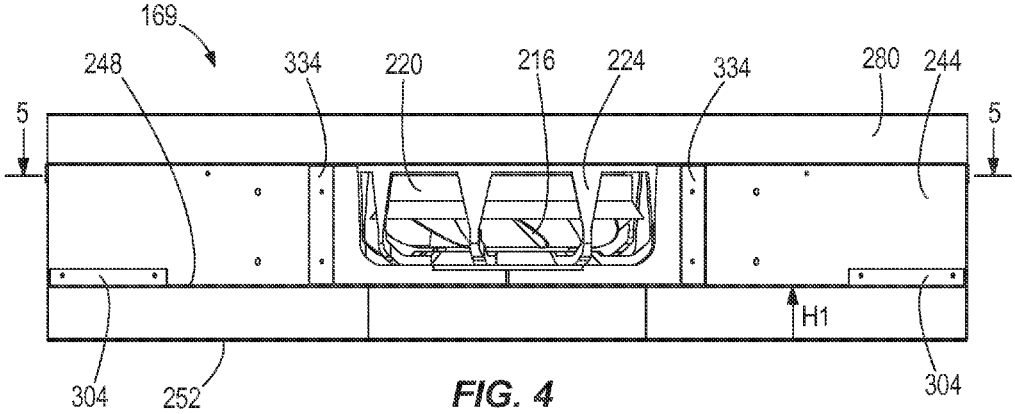
FIG. 4 is a front view of the fan apparatus of FIG. 2.
Figure 5:
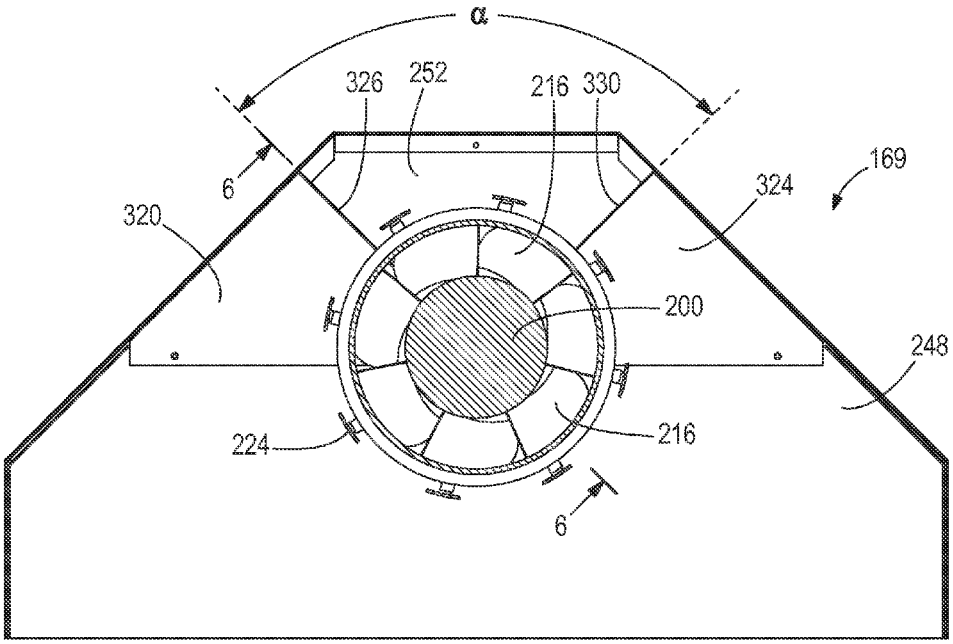
FIG. 5 is a section view of the fan apparatus of FIG. 4 taken along line 5-5.

With reference to FIGS. 2, 4, and 5, the plenum 172 includes a top wall 240, a surrounding multi-sectioned side wall 244, a primary duct base 248, a secondary duct base 252, and a divider 260 that cooperate to partition the plenum into a primary duct 264 and a secondary duct 266 (see FIG. 2). The plenum 172 can be formed from any suitable material (e.g., sheet metal such as galvanized steel, aluminum, or stainless steel, plastic, etc.).

Figure 3:
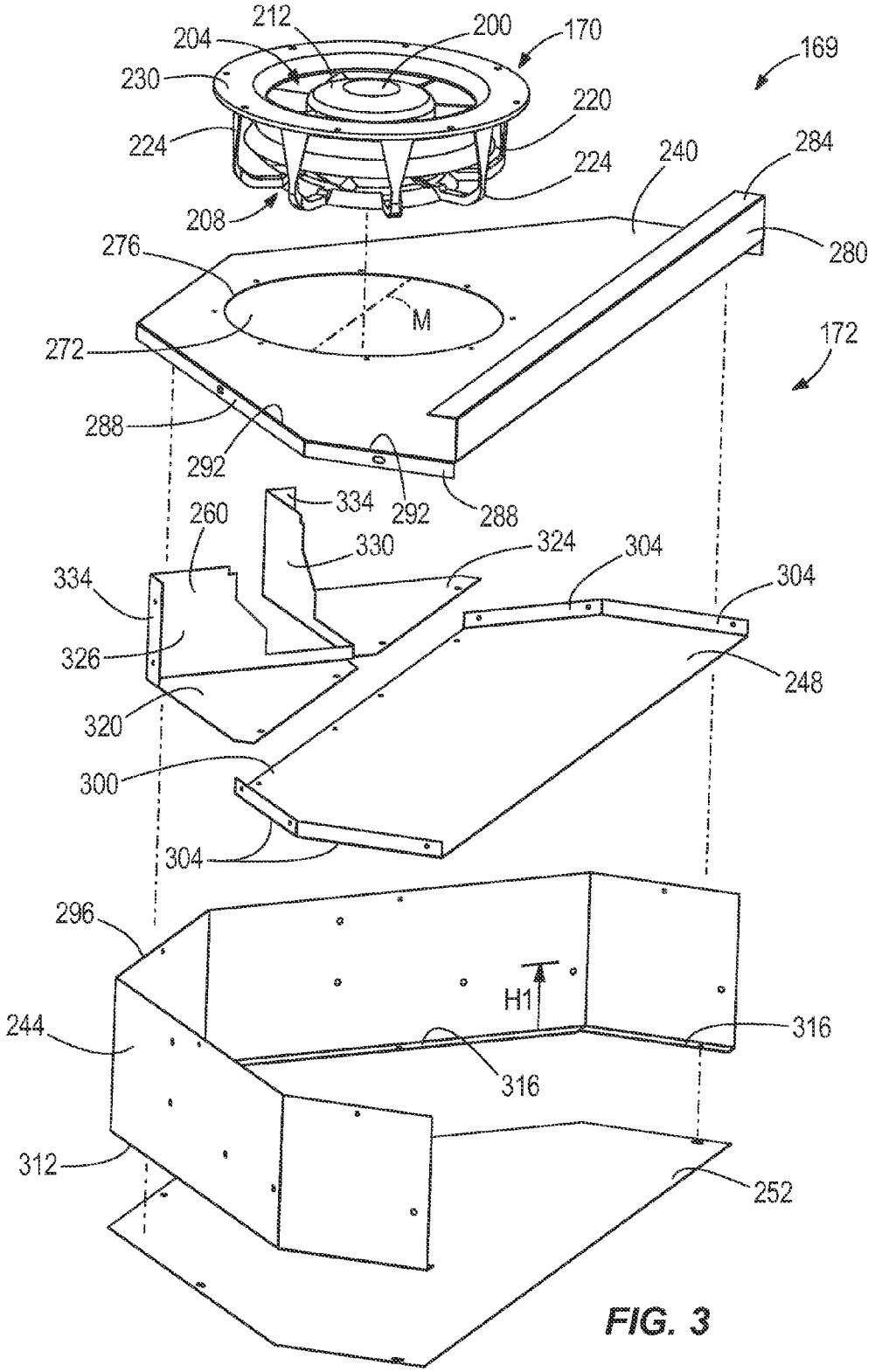
FIG. 3 is an exploded perspective view of the fan apparatus of FIG. 2.

With reference to FIG. 3, the top wall 240 includes a fan aperture 272 with a centerline M and a perimeter 276 to which the fan assembly 170 is secured (e.g., using conventional mounting hardware) via the flange 230. A rim 280 extends upward from and across an edge of the top wall 240 and includes an inward projecting edge 284. The top wall 240 spans the entirety of the area partially enclosed by the side wall 244. As illustrated, the top wall 240 includes tabs 288 at each edge 292 that secure the top wall 240 to the top edge 296 of the side wall 244.

The primary duct base 248 is disposed below and spaced from the top wall 240 to accommodate the fan assembly 170. The primary duct base 248 spans an area from the front rim 280 of the top wall 240 rearward to an edge 300 that is substantially coincident with the centerline M of the fan aperture 272. The primary duct base 248 is positioned substantially parallel to the top wall 240 and includes tabs 304 that removably secure the primary duct base 248 to the side wall 244 at an adjustable intermediate height H1 above a bottom edge 312 of the side wall 244.

The secondary duct base 252, which is located below the primary duct base 248, spans the entirety of the area partially enclosed by the side wall 244. The secondary duct base 252 is coupled to a plurality of bottom tabs 316 extending from the bottom edge 312 of the side wall 244.

With continued reference to FIG. 3, the divider 260 includes a first base member 320 and a second base member 324 that support a first wall member 326 and a second wall member 330, respectively. The first and second base members 324, 326 are coupled to the edge 300 of the primary duct base 248 and are positioned substantially flush with the primary duct base 248 when assembled onto the primary duct base 248. The first and second wall members 326, 330 each have tabs 334 that secure the divider 260 to the side wall 244. The first and second wall members 326, 330 operably separate the primary duct 264 from the secondary duct 266 and are, in profile, shaped to conform to the components of the fan assembly 170, as will be further described in detailed below. Referring to FIG. 5, the divider wall members 326, 330 are angled apart from each other at an angle α. In the illustrated embodiment, the angle α is approximately 90°. In other constructions, the angle α can range from approximately 45° to approximately 180°.

Figure 6:
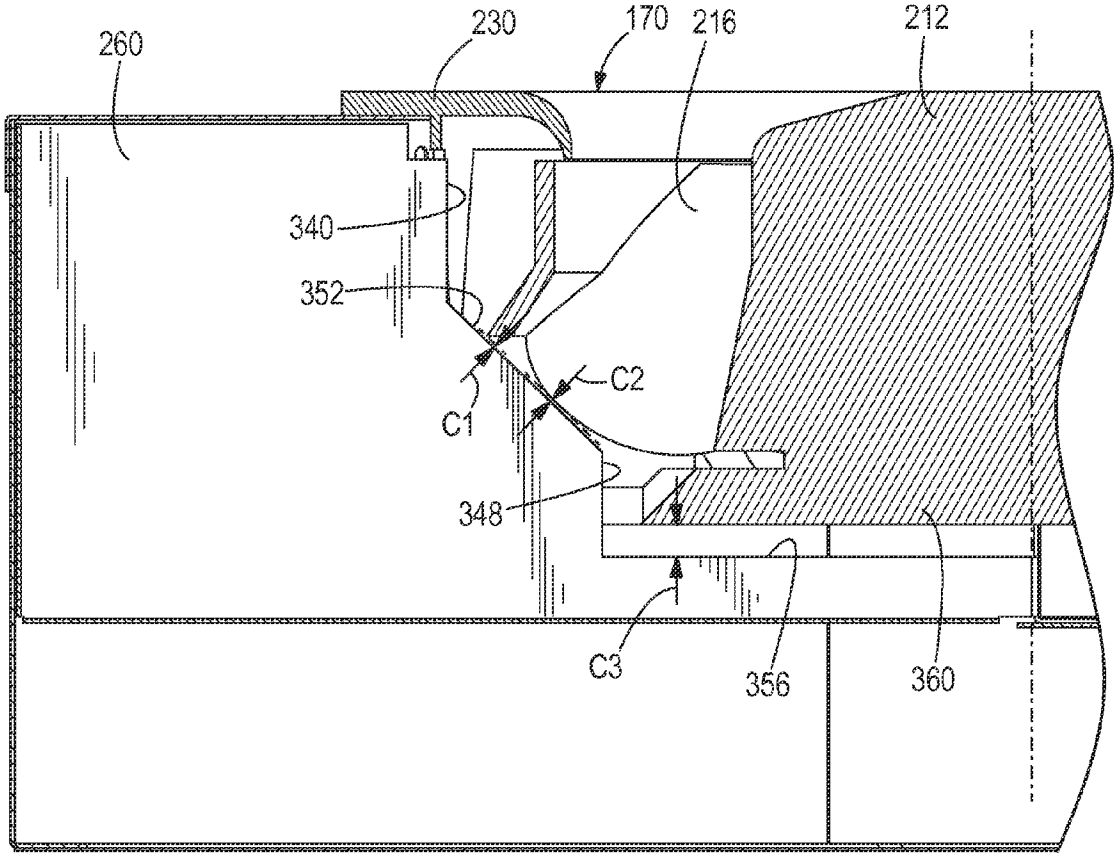
FIG. 6 is a section view of a portion of the fan apparatus of FIG. 5 taken along line 6-6.

FIG. 6 shows the structural relationship between the fan assembly 170 and the first divider wall 326. As illustrated, the divider wall 326 includes a first vertical edge 340 that is interconnected with a second vertical edge 348 via an angled edge 352, and a bottom edge 356 extending substantially horizontal from the second vertical edge 348. The fan assembly 170 is positioned so that a clearance C1 exists between the shroud 220 and the angled edge 352, and a clearance C2 exists between the tip of the fan blade 216 and the angled edge 352. To further facilitate fluid separation between the primary duct 264 and the secondary duct 266, the bottom edge 356 is positioned so that a clearance C3 exists between a bottom portion 360 of the hub 212 and the bottom edge 356. As illustrated, the clearance C1 is approximately 2 millimeters, the clearance C2 is approximately 2 millimeters, and the clearance C3 is approximately 9 millimeters, although other distances for the clearances C1, C2, C3 are also considered herein. For example, the clearance C1 can be between about 1 millimeter and about 18 millimeters, the clearance C2 can be between about 1 millimeter and about 13 millimeters, and the clearance C3 can be between about 3 millimeters and 25 millimeters.

Figure 8:
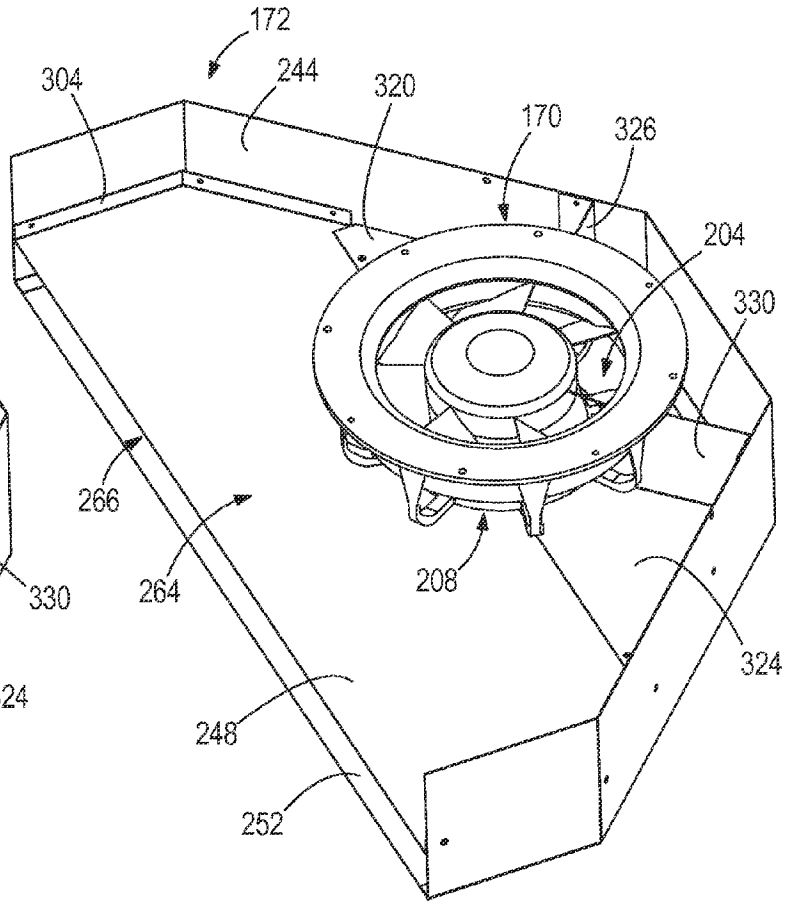
FIG. 8 is a perspective view of a portion of the fan assembly and the plenum of FIG. 2.
Figure 7:
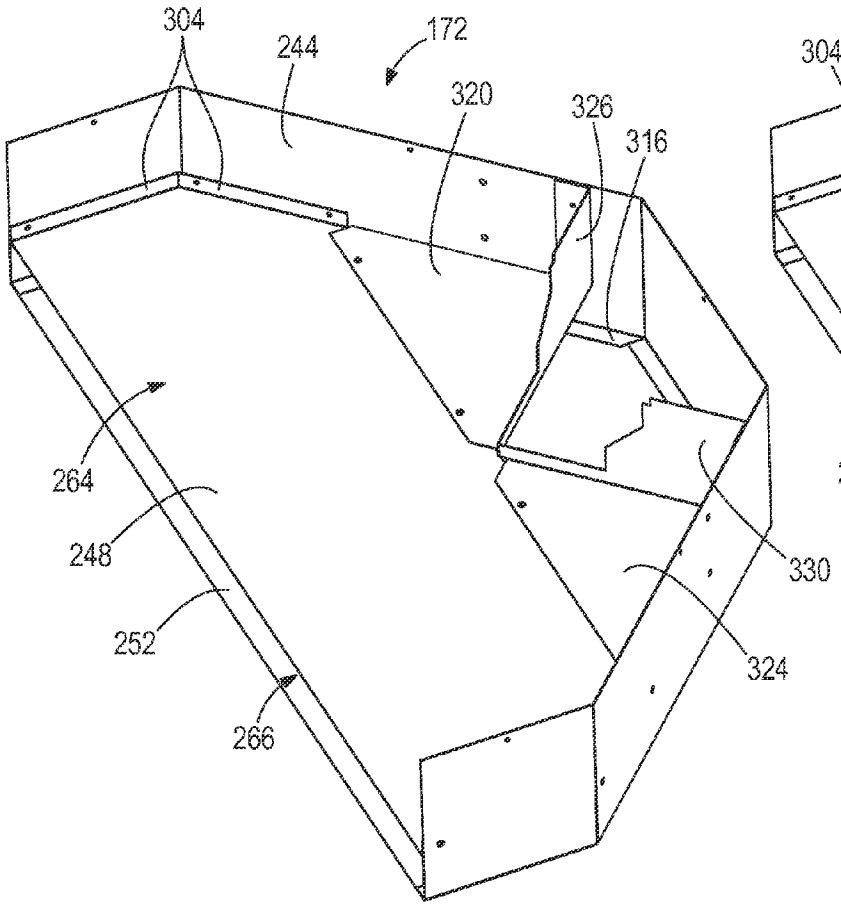
FIG. 7 is a perspective view of a portion of the plenum of FIG. 2.

Referring to FIGS. 7 and 8, the primary duct 264 generally defines a volume between the top wall 240 (not illustrated in FIGS. 7 and 8 for clarity), the primary duct base 248, the side wall 244, and the first and second divider walls 326, 330 that is in fluid communication with the fan outlet 208. The secondary duct 266 generally defines a volume between the primary duct base 248, the secondary duct base 252, the side wall 244, and the first and second divider walls 326, 330 that also is in fluid communication with the fan outlet 208.

In some constructions, two separate fan assemblies 170 can be used within a single plenum 172. In these constructions, the discharged airflow of each fan 200 is separated by a respective divider 260 into the primary and secondary ducts 264, 266. Also, while the divider 260 is illustrated as being integrated into the plenum 172, the divider 260 can instead be integrated into the fan assembly 170. In yet another construction, the fan assembly 170 and plenum 172 can be positioned at the rear of the case 100 or at the top of the case 100 (with modifications made as necessary to the flues 148, 150, 158, 160 and the heat exchanger 190).

FIGS. 9-16 show another fan apparatus 469 for use with the merchandiser 10. Except as described below, the fan apparatus 469 is the same as the fan apparatus 169 and like elements are given the same reference numerals.

Figure 9:
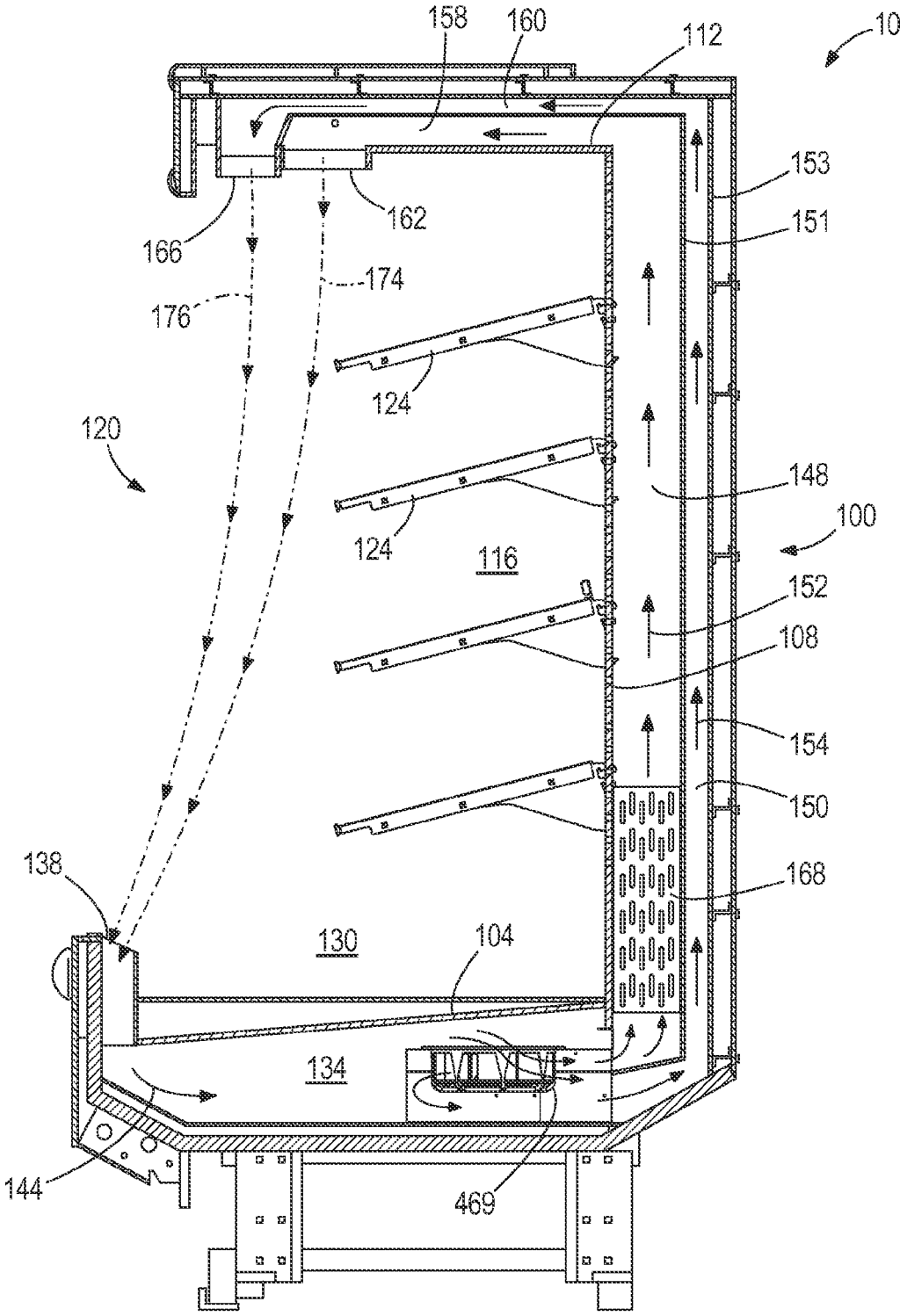
FIG. 9 is a section view of the merchandiser of FIG. 1 including another fan apparatus embodying the invention.

With reference to FIG. 9, the fan apparatus 469 is positioned in the base 104 and is in fluid communication with the lower flue 134. As shown in FIGS. 10-13, the fan apparatus 469 includes a fan assembly 470 and a plenum 472 that generates and divides the airflow 144 into the primary airflow 152 and the secondary airflow 154. As illustrated, the fan assembly 470 and the plenum 472 form a modular assembly. In some constructions, the fan assembly 470 and the plenum 472 can extend the length of the merchandiser 10.

The fan assembly 470 has a fan 500 (e.g., a centrifugal fan) with an inlet 504, an outlet 508, and a hub 512 that is powered by a motor (not shown). The hub 512 supports a plurality of fan blades 516. Support arms 524 form a basket that surrounds the fan blades 516. Each support arm 524 adjoins a flange 530 that couples the fan assembly 470 to the plenum 472.

Figure 10:
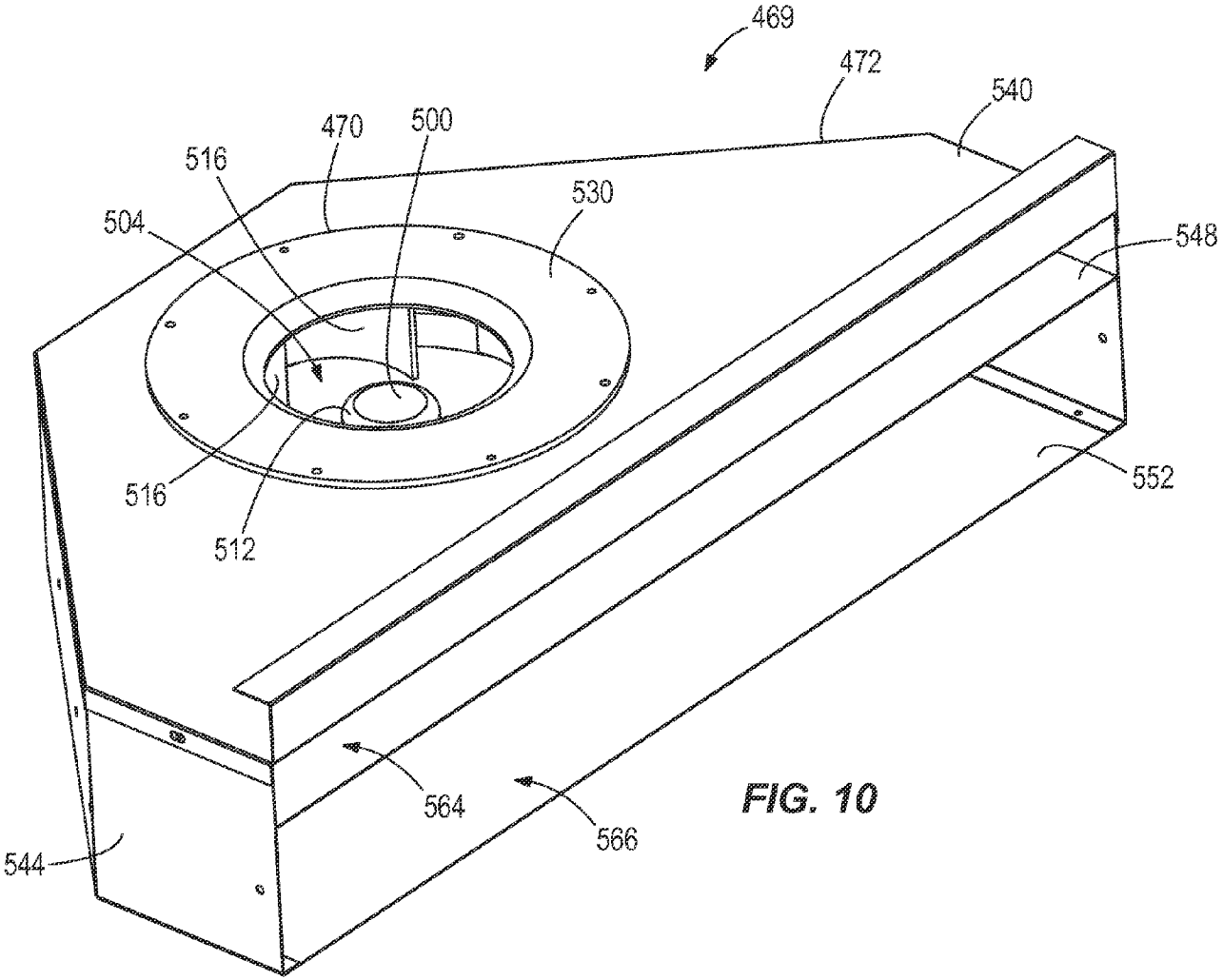
FIG. 10 is a perspective view of the fan apparatus including a fan assembly and a plenum of FIG. 9.
Figure 11:
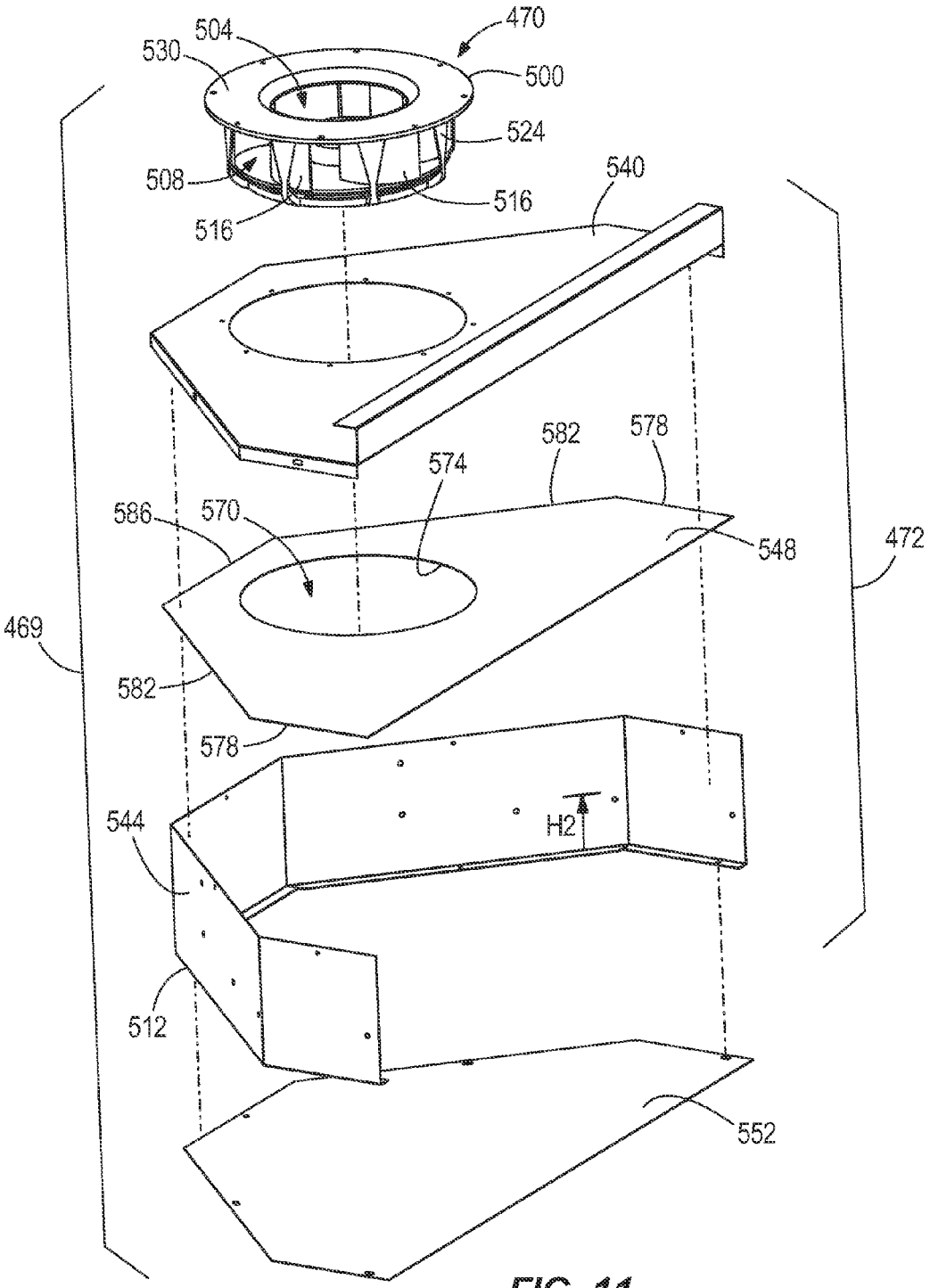
FIG. 11 is an exploded perspective view of the fan apparatus of FIG. 10.
Figure 12:
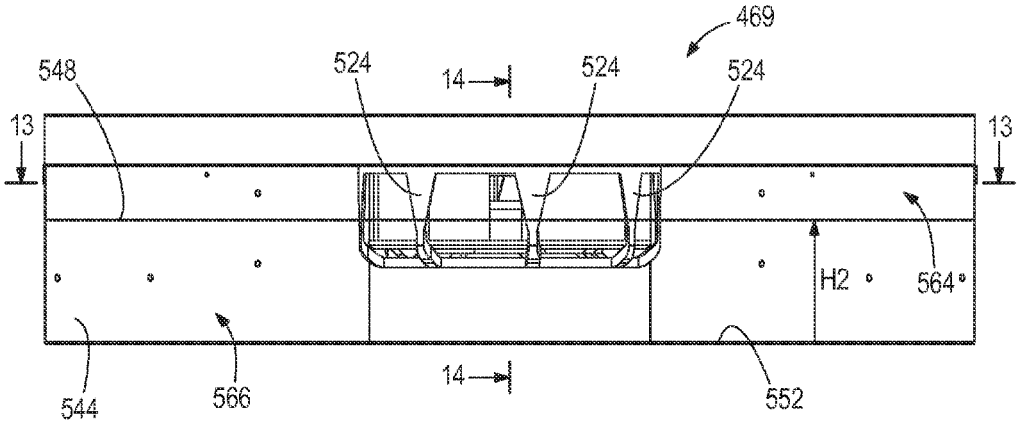
FIG. 12 is a front view of the fan apparatus of FIG. 10.
Figure 13:
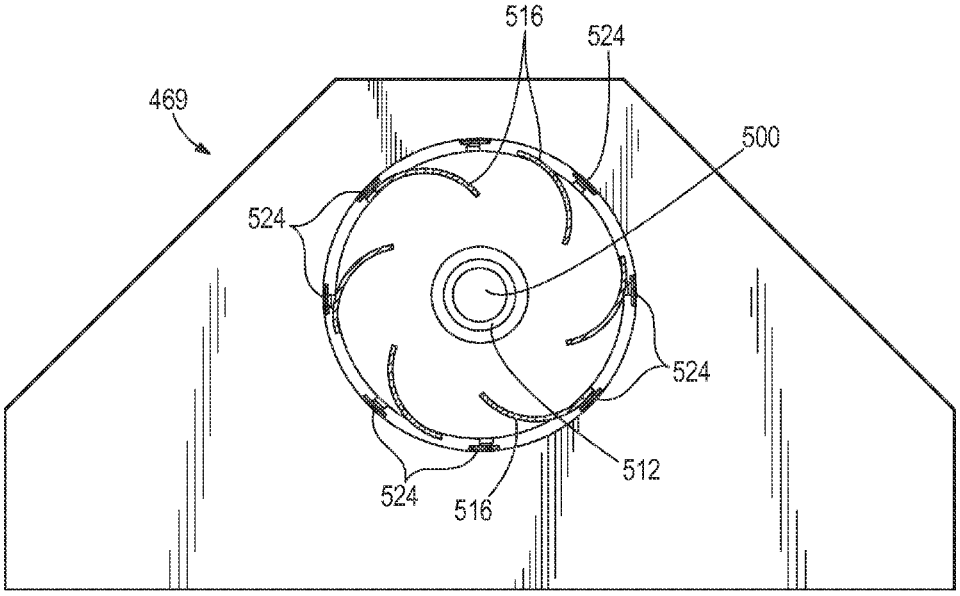
FIG. 13 is a section view of the fan apparatus of FIG. 12 taken along line 13-13.

With reference to FIGS. 10, 12, and 13, the plenum 472 includes a top wall 540, a surrounding multi-sectioned side wall 544, a divider 548, and a base 552 that cooperate to partition the plenum into a primary duct 564 and a secondary duct 566 (see FIG. 10). The top wall is identical to the top wall 240 described with regard to FIG. 3. Likewise, the sidewall 544 is the same as the sidewall 244, and the base 552 is the same as the base 252.

The divider 548 is disposed below and spaced from the top wall 540. The divider 548 spans the entirety of the area partially enclosed by the side wall 544 and includes an opening 570, the perimeter 574 of which uniformly surrounds the support arms 524 adjacent the outlet 508 of the fan 500. The divider 548 is positioned substantially parallel to the top wall 540 and is removably secured at its lateral edges 578, 582 and back edge 586 to the side wall 544 at an intermediate height H2 above the bottom edge 512 of the side wall 544. As described in detail below, this intermediate height H2 can be changed to adjust the quantity of air directed into each of the primary and secondary rear flues 148, 150.

Figure 14:
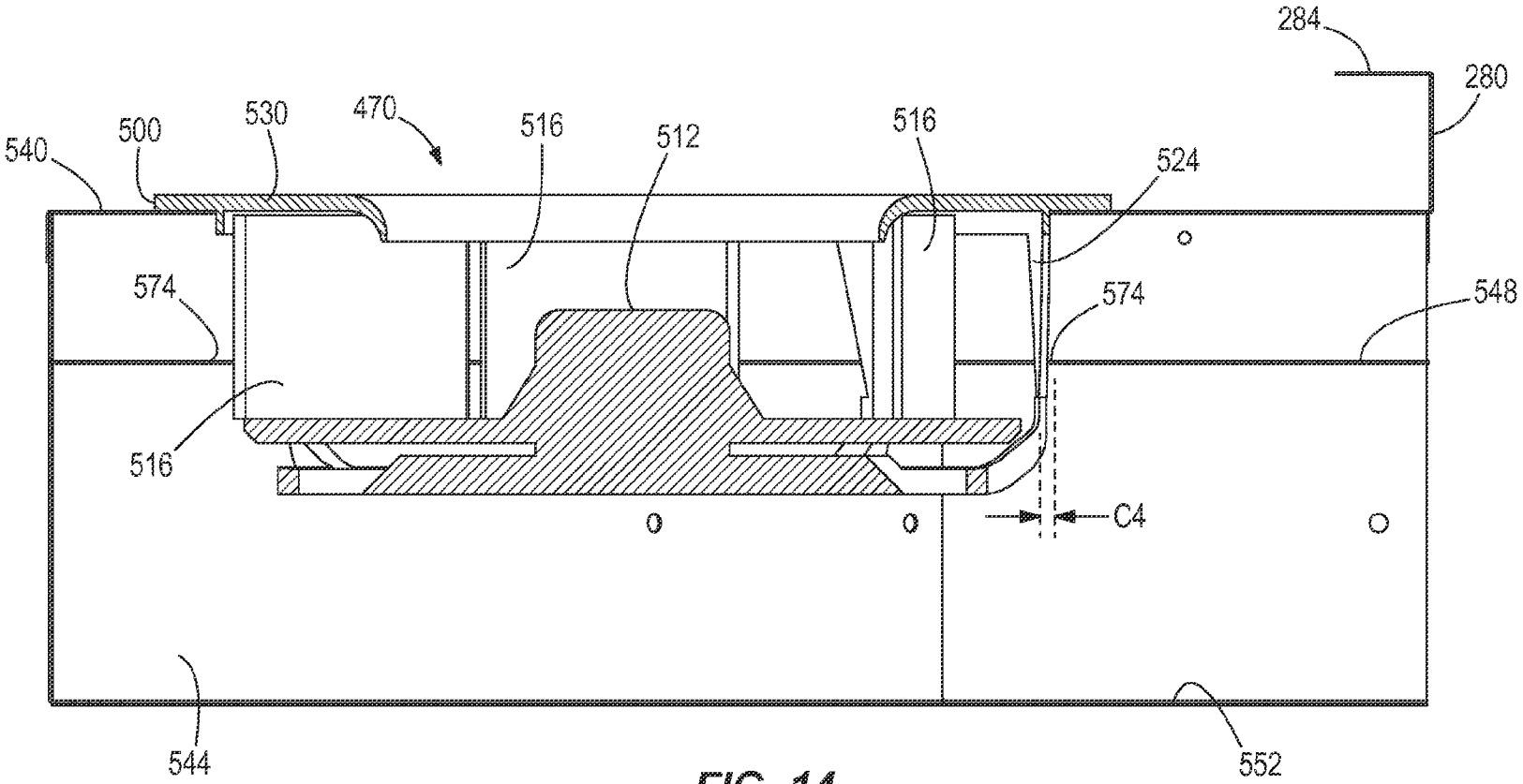
FIG. 14 is a section view of a portion of the fan apparatus of FIG. 12 taken along line 14-14.

FIG. 14 shows the structural relationship between the fan assembly 470 and the divider 548. As illustrated, the divider 548, and more specifically the opening perimeter 574, is positioned so that a clearance C4 exists between the support arms 524 and the perimeter 574. As illustrated, the clearance C4 is approximately 3 millimeters, although other distances for the clearance C4 are also considered herein (e.g., 1 millimeter, 5 millimeters, 20 millimeters, etc.).

Figure 16:
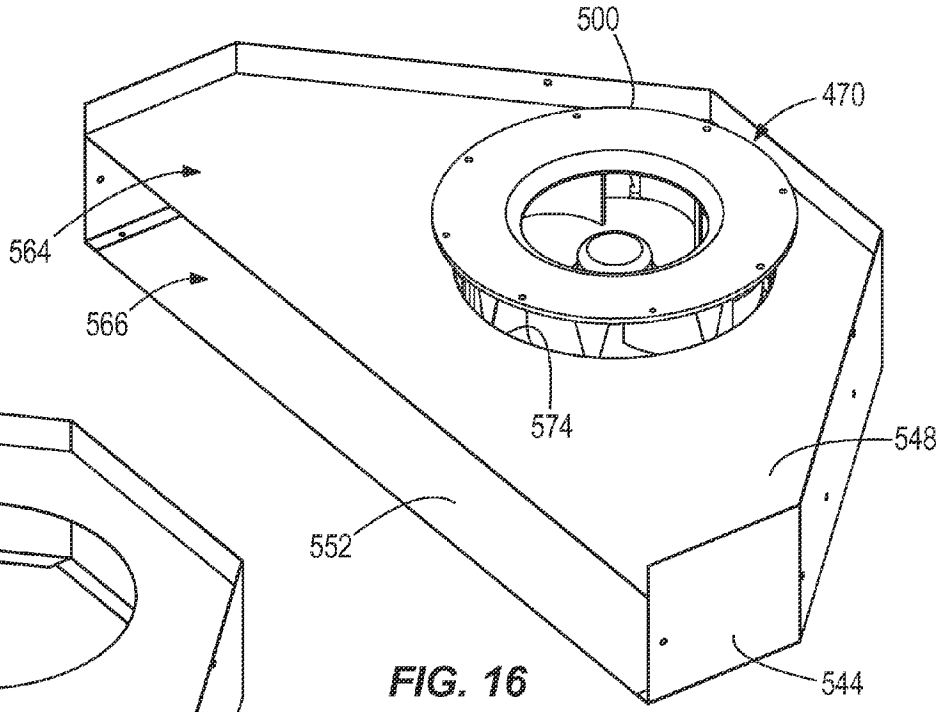
FIG. 16 is a perspective view of a portion of the fan assembly and the plenum of FIG. 10.
Figure 15:
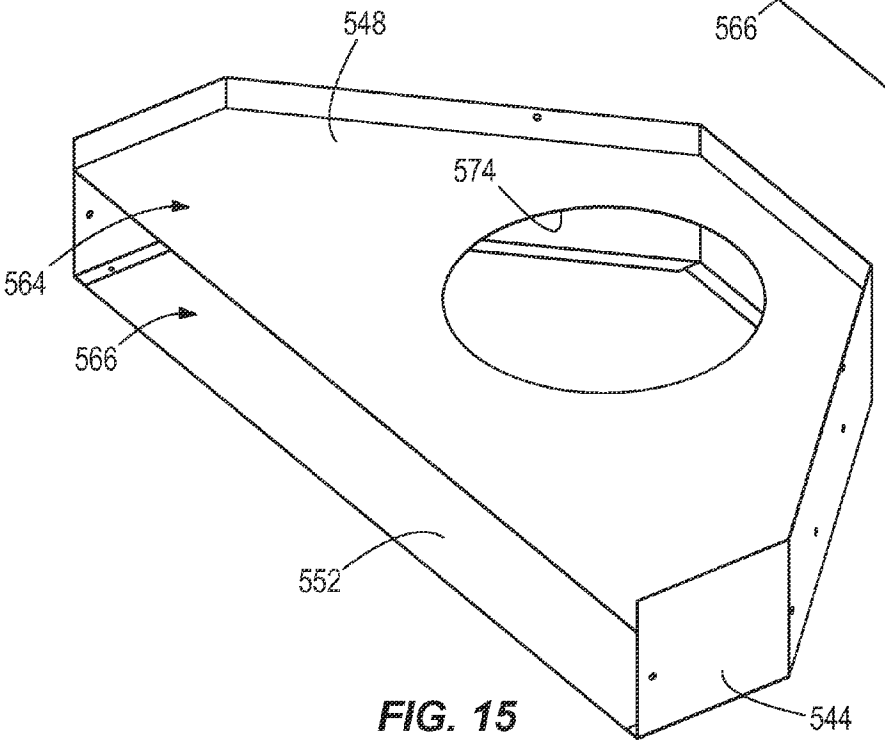
FIG. 15 is a perspective view of a portion of the plenum of FIG. 10.

Referring to FIGS. 15 and 16, the primary duct 564 generally defines a volume between the top wall 540 (not illustrated in FIGS. 7 and 8 for clarity), the divider 548, and the side wall 544 that is in fluid communication with the fan outlet 508. The secondary duct 566 generally defines a volume between the divider 548, the base 552, and the side wall 544 that also is in fluid communication with the fan outlet 508.

In some constructions, two separate fan assemblies 470 can be used within a single plenum 472. In these constructions, the discharged airflow of each fan 500 is separated by a divider 548 into the primary and secondary ducts 564, 566. Also, while the divider 548 is illustrated as being integrated into the plenum 472, the divider 548 can instead be integrated into the fan assembly 470. In yet another construction, the fan assembly 470 and plenum 472 can be positioned at the rear of the case 100 or at the top of the case 100 (with modifications made as necessary to the flues 148, 150, 158, 160 and the heat exchanger 190).

With regard to the fan apparatus 169, in operation, the rotating fan 200 draws the airflow 144 through the lower flue 134 to the fan inlet 204. The plenum 172 and the divider 260 cooperate to split the airflow 144 into the primary airflow 152 and the secondary airflow 154 at the outlet 208. The primary airflow 152 flows through the primary duct 264, the heat exchanger 190, the primary rear flue 148, the primary upper flue 158, and the outlet 162 to form the cooled or refrigerated primary air curtain 174.

The secondary airflow 154 flows through the secondary duct 264, the secondary rear flue 150, the secondary upper flue 160, and the outlet 166, bypassing the heat exchanger 190, to form the secondary air curtain 176. As described, the secondary air curtain 176 buffers the primary air curtain 174 to limit infiltration of ambient air into the product display area 116. At least some air from either or both the primary air curtain 174 and the secondary air curtain 176 is drawn into the lower flue 134 through the inlet 138, which in turn forms the airflow 144.

The fan apparatus 169 can be adjusted or modified based on desired characteristics for the primary airflow 152 and the secondary airflow 154 (e.g., how much air defines each airflow). For example, the distances associated with one or more of the clearances C1, C2, C3 can be adjusted to control the interaction between the primary and secondary airflows 152, 154. If a greater level of interaction is desired (i.e., more mixing of the airflows 152, 154 prior to entry into the ducts 264, 266), the distance of any or all of the clearances C1, C2, C3 can be enlarged. Conversely, if a lower level of interaction is desired, (i.e., more independence between the airflows 152, 154), the distance of any or all of the clearances C1, C2, C3 can be reduced.

Generally, smaller distances for the clearances C1, C2, C3 result in greater independence between the airflows 152, 154 by limiting airflow crossover from one duct to the other. As a result, different static pressures can be maintained in each duct 264, 266. Therefore, a relatively constant air volume can be maintained in one of the primary and secondary ducts 264, 266 regardless of changes to static pressure in the other of the primary and secondary ducts 264, 266. As illustrated, the airflows 152, 154 are substantially independent such that the primary airflow 152 is relatively unaffected by changing air pressures or air volumes of the secondary airflow 154. Likewise, the secondary airflow 154 is relatively unaffected by changing air pressures or air volumes of the primary airflow 152.

The quantity of air discharged as the primary airflow 152 and the secondary airflow 154 is proportional to the angle $\alpha$. As the angle $\alpha$ increases, more air flows to the secondary duct 266 and less air flows to the primary duct 264, increasing the quantity of air defining the secondary airflow 154 (and thus the quantity of air defining the secondary air curtain 176), and decreasing the quantity of air defining the primary airflow 152 (and thus the quantity of air defining the primary air curtain 174). As the angle $\alpha$ decreases, less air flows to the secondary duct 266 and more air flows to the primary duct 264, increasing the quantity of air defining the primary airflow 152 and the primary air curtain 174 and decreasing the quantity of air defining the secondary airflow 154 and the secondary air curtain 176.

The configuration of the plenum 172 with the divider 260 allows a single fan assembly 170 to create two distinct air curtains 174, 176 for maintaining the product display area 116 at desired predetermined conditions. Using one fan rather than two fans reduces component and electrical power costs and simplifies assembly and maintenance of the merchandiser 10.

Except as described below, the fan apparatus 469 including the fan assembly 470 and the plenum 472 described with regard to FIGS. 9-16 operates the same as the fan apparatus 169 described with regard to FIGS. 1-8.

In particular, the fan apparatus 469 can be adjusted or modified based on desired characteristics for the primary airflow 152 and the secondary airflow 154 (e.g., how much air defines each airflow). For example, the distance associated with the clearance C4 can be adjusted to control the interaction between the primary and secondary airflows 152, 154. If a greater level of interaction is desired (i.e., more mixing of the airflows 152, 154 prior to entry into the ducts 564, 566), the dimension of the clearance C4 can be enlarged. Conversely, if a lower level of interaction is desired, (i.e., more independence between the airflows 152, 154), the dimension of the clearance C4 can be reduced.

Generally, a smaller dimension for the clearance C4 results in greater independence between the airflows 152, 154 by limiting airflow crossover from one duct to the other. As a result, different static pressures can be maintained in each duct 564, 566. Therefore, a relatively constant air volume can be maintained in one of the primary and secondary ducts 564, 566 regardless of changes to static pressure in the other of the primary and secondary ducts 564, 566. As illustrated, the airflows 152, 154 are substantially independent such that the primary airflow 152 is relatively unaffected by changing air pressures or air volumes of the airflow 154. Likewise, the secondary airflow 154 is relatively unaffected by changing air pressures or air volumes of the primary airflow 152.

The quantity of air discharged as the primary airflow 152 and the secondary airflow 154 is proportional to the vertical position of the divider 548 within the plenum 472 (i.e., the height H2). As the dimension of the height H2 increases, more air flows to the enlarged secondary duct 566 and less air flows to the reduced primary duct 564, which in turn affects the amount of air defining the primary and secondary air curtains 174, 176. Specifically, the enlarged secondary duct 566 increases the quantity of air defining the secondary air curtain 176 and the reduced primary duct 564 decreases the quantity of air defining the primary air curtain 174. Conversely, as the height H2 decreases, less air flows to the reduced secondary duct 566 and more air flows to the enlarged primary duct 564, increasing the quantity of air defining the primary air curtain 174 and decreasing the quantity of air defining the secondary air curtain 176.

Various features and advantages of the invention are set forth in the following claims.

What is claimed is:

1. A refrigerated merchandiser comprising:

a case defining a product display area and including a base, a lower flue, a first air passageway, and a second air passageway, the first air passageway and second air passageway in fluid communication with the lower flue and with the product display area;

an evaporator positioned in the first air passageway;

a fan assembly with a single fan positioned in the base in fluid communication with the lower flue to generate an airflow; and a fan plenum into which the fan assembly is disposed, the fan plenum including an airflow divider to direct a first portion of the airflow to the first air passageway and to direct a second portion of the airflow to the second air passageway, wherein the proportion of air between the first portion and the second portion is a function of a position and geometry of the airflow divider, wherein the fan plenum includes a top wall, a side wall, and a plenum base, and wherein the airflow divider partitions the fan plenum into a first duct and a second duct, the first duct in communication with the first air passageway and the second duct in communication with the second air passageway, wherein the airflow divider includes a first wall member and a second wall member, wherein the first wall member and the second wall member operably separate the first duct from the second duct, and wherein the first wall member and the second wall member are orthogonal to the top wall, and further wherein an angular separation $\alpha$ of the first wall member from the second wall member ranges from about 45° to about 180°, wherein an increase in α decreases the proportion of air between the first portion and the second portion of the airflow.

2. The refrigerated merchandiser of claim 1, wherein the single fan is an axial flow fan.

3. The refrigerated merchandiser of claim 1, wherein the single fan is a centrifugal fan.

4. The refrigerated merchandiser of claim 3, wherein the airflow divider is positionally adjustable.

5. The refrigerated merchandiser of claim 1, wherein the plenum base is positioned parallel to the top wall.

6. The refrigerated merchandiser of claim 1, wherein the side wall includes a bottom edge, and wherein the plenum base is removably secured to the side wall and is adjustable relative to the bottom edge.

7. The refrigerated merchandiser of claim 1, wherein the angular separation α of the first wall member from the second wall member is about 90°.

8. A refrigerated merchandiser comprising:

a case defining a product display area and including a base, a lower flue, a first air passageway, and a second air passageway, the first air passageway and second air passageway in fluid communication with the lower flue and with the product display area;

an evaporator positioned in the first air passageway;

a fan assembly positioned in the base in fluid communication with the lower flue to generate an airflow; and a fan plenum including a top wall, a side wall, and a plenum base into which the fan assembly is disposed, the fan plenum further including an airflow divider having a first wall member and a second wall member that operably separate the fan plenum into a first duct in communication with the first air passage way and a second duct in communication with the second air passageway, wherein the first wall member and the second wall member are orthogonal to the top wall, and further wherein an angular separation α of the first wall member from the second wall member ranges from about 45° to about 180°, the air flow divider configured to direct a first portion of the airflow to the first air passageway and to direct a second portion of the airflow to the second air passageway, wherein a change in a changes the proportion of air between the first portion and the second portion of the airflow.

9. A refrigerated merchandiser comprising:

a case defining a product display area and including a base, a lower flue, a first air passageway, and a second air passageway, the first air passageway and second air passageway in fluid communication with the lower flue and with the product display area;

an evaporator positioned in the first air passageway;

a fan assembly with a single fan positioned in the base in fluid communication with the lower flue to generate an airflow; and a fan plenum into which the fan assembly is disposed, the fan plenum including an airflow divider to direct a first portion of the airflow to a first duct in communication with the first air passageway and to direct a second portion of the airflow to a second duct in communication with the second air passageway, wherein the proportion of air between the first portion and the second portion is a function of a position and geometry of the airflow divider, and wherein the airflow divider includes a first wall member and a second wall member, wherein the first wall member and the second wall member operably separate the first duct from the second duct, and wherein the second duct is partially defined between the first wall member and the second wall member.

10. The refrigerated merchandiser of claim 9, wherein the airflow divider is positionally adjustable.

11. The refrigerated merchandiser of claim 9, wherein the fan plenum includes a top wall, a side wall, and a plenum base, and wherein the side wall includes a bottom edge, and further wherein the plenum base is removably secured to the side wall and is adjustable relative to the bottom edge.

12. The refrigerated merchandiser of claim 11, wherein the plenum base is positioned parallel to the top wall.

13. The refrigerated merchandiser of claim 9, wherein the fan plenum includes a top wall, a side wall, and a plenum base, and wherein the first wall member and the second wall member are orthogonal to the top wall, and further wherein an angular separation α of the first wall member from the second wall member ranges from about 45° to about 180°, whereby a quantity of air discharged to the first air passageway with respect to the second air passageway is proportional to α.

14. The refrigerated merchandiser of claim 13, wherein the angular separation α of the first wall member from the second wall member is about 90°.

15. The refrigerated merchandiser of claim 9, wherein the single fan is a centrifugal fan.

* * * * *